US006408733B1

(12) United States Patent
Perciballi

(10) Patent No.: US 6,408,733 B1
(45) Date of Patent: Jun. 25, 2002

(54) CERAMIC ARMOR APPARATUS FOR MULTIPLE BULLET PROTECTION

(76) Inventor: William J. Perciballi, 910 E. Mountain Sky Ave., Phoenix, AZ (US) 85048

( * ) Notice: Subject to any disclaimer, the term of this patent is extended or adjusted under 35 U.S.C. 154(b) by 0 days.

(21) Appl. No.: 09/503,494

(22) Filed: Feb. 14, 2000

(51) Int. Cl.[7] ..... F41H 5/04; F41H 5/08; F41H 1/02

(52) U.S. Cl. ..... 89/36.02; 89/36.05; 2/2.5

(58) Field of Search ..... 89/36.02, 36.05, 89/36.07, 36.08, 36.11, 36.12; 428/911; 2/2.5; 109/49.5

(56) References Cited

U.S. PATENT DOCUMENTS 3,719,545 A * 3/1973 Lawler ..... 161/216
5,469,773 A * 11/1995 Tarpinian ..... 89/36.02
H1519 H * 3/1996 Semple ..... 89/36.02
5,981,048 A * 11/1999 Sugimoto et al. ..... 428/910
6,009,789 A * 1/2000 Lyons ..... 89/36.02
6,119,575 A * 9/2000 Dragone et al. ..... 89/36.05

FOREIGN PATENT DOCUMENTS

EP 376794 * 7/1990 ..... 89/36.02
GB 1151441 * 5/1969 ..... 89/36.02

* cited by examiner

*Primary Examiner*—Stephen M. Johnson

(57) ABSTRACT

Armor apparatus comprising a non-oxide ceramic element bounded to an aramid fiber composite baking. A special ceramic and a novel aramid fiber substrate are combined in a unique arrangement that permits a single armor system to provide protection against multiple types of ballistic attack. The armor apparatus may be used alone or as a supplementary armor system to provide increased protection from ballistic attack.

24 Claims, 1 Drawing Sheet

CERAMIC ARMOR APPARATUS FOR MULTIPLE BULLET PROTECTION

BACKGROUND OF THE INVENTION

1. Field of the Invention

This invention relates to ceramic armor and, more particularly, to a single ceramic armor for protecting against multiple small arms bullets.

2. Description of the Prior Art

Ceramic armor is typically used for body armor and for the outer coverings of different types of vehicles, such as various types of land vehicles, ships, and aircraft. Typically, ceramic tiles are adhesively secured to a substrate then encapsulated in an outer cover. The armor system is then attached to a vehicle by a variety of means or merely placed in a fabric pocket, as in the case of body armor.

An inherent problem is the prior art is that ceramic armor is configured for a fixed level of protection against a singular ballistic threat.

The apparatus of the present invention overcomes the deficiencies of the prior art by providing a single arrangement of ceramic and substrate to provide protection against a variety of bullets. The appropriate ceramic and substrate arrangement provides protection against both lead-filled and steel-filled bullets with calibers of 5.56 mm and 7.62 mm, which are the common calibers used by military and civilian rifles.

The apparatus may be used with or without a supplementary armor system such as a body armor vest or the outer skin of a vehicle. Stealth and other features, such as durability, drop protection, field abuse, spall mitigation, etc., may also be included in the apparatus.

SUMMARY OF THE INVENTION

The ceramic armor apparatus of the present invention described and claimed herein comprises a ceramic facing element bonded to an aramid fiber composite substrate. The ceramic armor apparatus of the present invention provides protection against a 5.56 mm M193 bullet, a 5.56 mm M855 bullet, a 5.56 mm SS109 bullet, a Ace 7.62 mm M80 bullet, a 7.62 mm LPS bullet, and a 7.62 mm PS bullet either alone or in any combination thereof. The ceramic facing element may consist of a plurality of elements, such as tiles, or may be a singular ceramic plate that is either flat or molded to the desired shape. The aramid fiber composite substrate is comprised of a plurality of layers of aramid fibers arranged in either fabric or unidirectional tape structures. The aramid fiber composite substrate layers are stacked to achieve the desired thickness and protection, and are laminated using a variety of polymer compounds to create a singular element. The aramid fiber composite substrate is arranged to be generally parallel to the ceramic facing element such that the shape of the aramid fiber composite substrate mirrors that of the ceramic facing element.

Among the objects of the following invention are the following:

To provide a new and useful means of protecting against ballistic attack;

To provide a new and useful means of arranging ceramic tile armor elements disposed on a substrate;

To provide a new and useful means of arranging a composite armor substrate in conjunction with a ceramic facing;

To provide a new and useful ceramic armor system for protection against multiple ballistic threats, To provide a new and useful means of minimizing the weight of a ceramic armor system for ballistic protection; and To provide a new and useful means of creating a supplementary armor plate for use in conjunction with an existing armor system.

BRIEF DESCRIPTION OF DRAWING

DRAWING FIGURES

Figure 1:
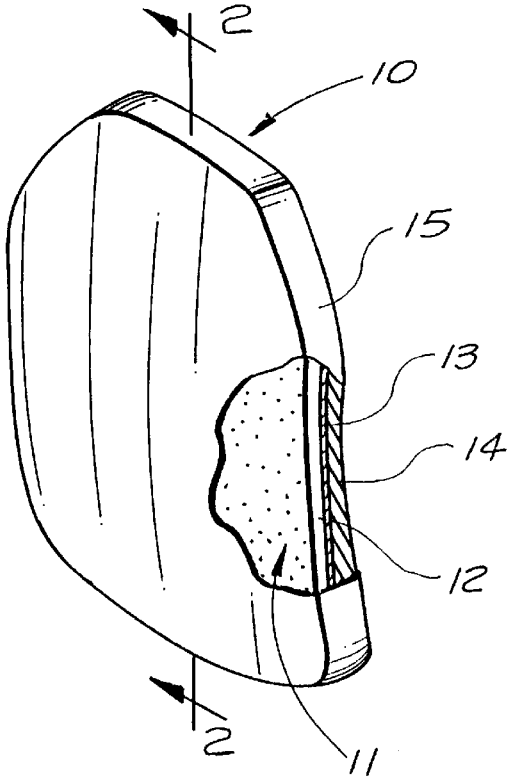

FIG. 1 is a perspective view of an embodiment of the apparatus of the present invention.

Figure 2:
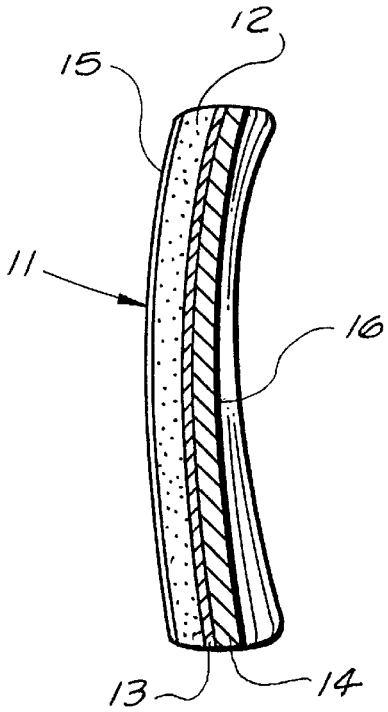

FIG. 2 is a view in partial section taken generally along line 2—2 of FIG. 1

Figure 3:
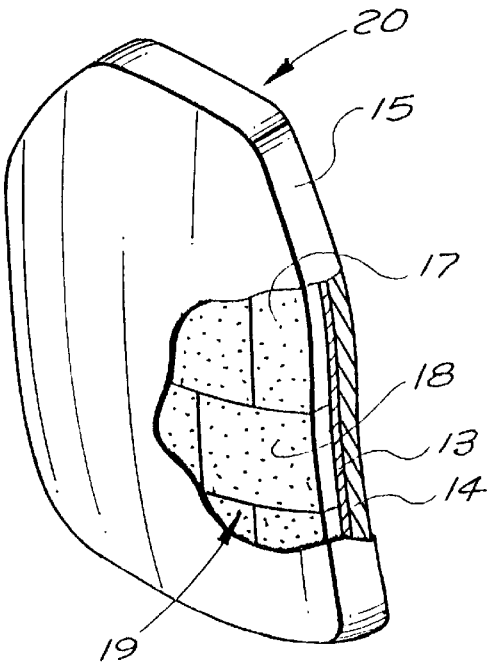

FIG. 3 is a perspective view of an alternate embodiment of the apparatus of the present invention.

Figure 4:
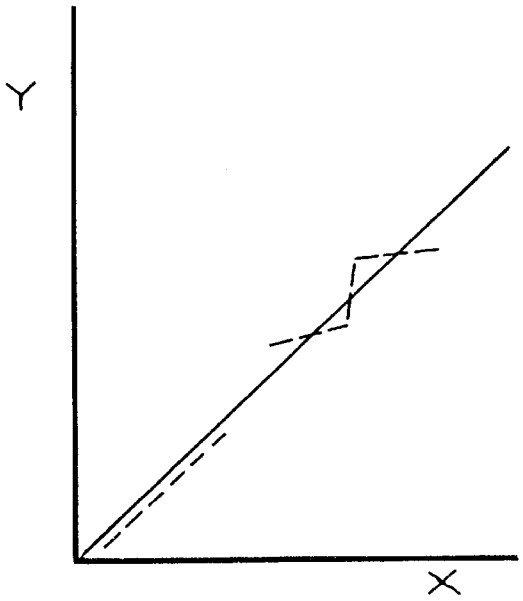

FIG. 4 illustrates via dotted lines the stitching or fiber axes relative to the x, y, and z-axis of fiber composite substrate plate 14.

REFERENCE NUMERALS IN DRAWINGS

Item 10 is the ceramic armor apparatus

Item 11 is a ceramic armor assembly comprised of Items 12, 13, and 14

Item 12 is the monolithic ceramic facing element

Item 13 is the adhesive element

Item 14 is the aramid fiber substrate element

Item 15 is the encapsulating cover

Item 16 is the optional rear portion of the encapsulating cover

Item 17 is the ceramic tile facing element

Item 18 is the ceramic tile facing element

Item 19 is the ceramic armor assembly comprised of Items 13, 14, 17, and 18

Item 20 is the ceramic armor apparatus alternate embodiment

DESCRIPTION OF PREFERRED EMBODIMENT

FIG. 1 is a perspective view, partially broken away and in partial section, of the ceramic armor apparatus 10 of the present invention. FIG. 2 is a view in partial section of the apparatus 10 taken generally along line 2—2 of FIG. 1. For the following discussion, reference will be made to FIGS. 1 and 2.

The ceramic armor apparatus 10 includes a cover 15 with the ceramic armor elements 11 deposed therein. The cover may include a back panel 16 that either partially or completely covers the rear surface of the plate. The cover may be comprised of a single material, such as nylon fabric, or may be a combination of fabric, rigid plastic, and foam that protects the ceramic from wear-and-tear and contains ceramic particles on impact as appropriate.

Within the ceramic armor elements 11 are the singular or monolithic ceramic tile or facing element 12, the adhesive layer element 13, and the aramid fiber composite substrate element 14. The combined thickness of the ceramic facing element 12, the adhesive layer element 13, and the aramid fiber composite substrate element 14 falls in the range between 0.430-inches and 0.530-inches inclusively. The combined weights of the ceramic facing element 12, the adhesive layer element 13, and the aramid fiber composite substrate element 14 falls in the range between 4.00- and 5.70-pounds-per-square-foot inclusively. The ceramic facing element 12 may be made of any appropriate non-oxide ceramic material, for example, Boron Carbide, Silicon Carbide ceramics. Alternatively, a ceramic matrix composite or metal matrix composite containing Silicon Carbide or Boron Carbide particles may be used. Although ceramic thickness may be varied to suit a specific need, the preferred ceramic arrangement ranges from 0.080-inches to 0.310-inches in thickness.

Disposed against and roughly parallel to back of the ceramic facing element 12 is the adhesive layer element 13 that forms a discreet layer.

The adhesive layer 13 may be made of any approximate polymer, for example. epoxy, polyurethane, polysulfide, polyolefin. The preferred thickness of the adhesive layer is controlled to result in a thickness between 0.002-inches and 0.090-inches. For convenience, the adhesive layer illustrated in the drawing Figures are cross hatches as metal.

Disposed against the back of the adhesive layer 13, and roughly parallel to the back of the ceramic facing element 12, is aramid fiber composite substrate element or plate 14.

The aramid fiber composite substrate plate 14 may be made of any appropriate aramid fiber such as Kevlar® or Twaron® fiber having a fineness ranging from 250- to 3,500-denier. Aramid fiber constructions such as fabrics, unidirectional tapes, felts, non-woven layers, or three-dimensional structures may be used. For example, aramid fiber fabrics in plain, basket, or twill weave styles with basis weights between 3.5- and 20.0-ounces-per-square-yard may be used; aramid fiber unidirectional tapes with all tapes arranged in 0, 15, 30, 45, 60, 90-degree orientation or combinations thereof may be used; or three dimensional structures that incorporate stitching or fiber axes along or about the z-axis of the fabric may be used. The aramid fiber composite substrate layer 14 is arranged to create a uniform structure that ranges from 0.130-inches to 0.350-inches thickness.

The aramid fibers of the aramid fiber composite substrate plate 14 are encased in a polymer matrix to from a rigid laminate. Virtually any appropriate polymer resin may be used for the matrix, for example Phenolic, Phenolic Polyvinyl Butyral rubber blends, Polyester, Vinylester, polyurethane, and polyolefin resins. For convenience, the aramid fiber composite substrate plates illustrated in the drawing Figures are cross hatches as metal.

When the aramid fiber composite substrate plate 14 employs a polymer resin matrix, the preferred resin content ranges from fifteen to twenty-four percent by weight.

An alternate embodiment 20 of the present invention is illustrated in FIG. 3. FIG. 3 comprises a perspective view, partially broken away and in partial section, of apparatus 20 of the present invention where the ceramic armor assembly 19 comprises a plurality of individual ceramic tile elements as exemplified by elements 17 and 18, the adhesive layer 13, and the aramid fiber composite substrate 14. The ceramic tile facing elements 17 and 18 can be square ceramic tiles or otherwise shaped to suit the dimensional needs of a particular application.

The remainder of the FIG. 3 elements are arranged and employed respectively in a similar manner as shown in FIGS. 1 and 2.

What I claim is:

1. Ceramic armor apparatus comprising in combination:

a ceramic facing element with thickness of 0.080-inches to 0.310 inches;

an adhesive layer with thickness ranging from 0.002-inches to 0.090-inches; and an aramid fiber composite substrate with thickness of 0.130-inches to 0.350-inches; the aramid fiber composite substrate comprising aramid fiber fabric in a plain, basket, or twill weave style with a basis weight between 3.5- and 20.0-ounces-per-square-yard.

2. The ceramic armor apparatus according to claim 1, wherein:

the aramid fiber fabric comprises aramid fibers with fineness ranging from 250- to 3,500-denier.

3. The ceramic armor apparatus according to claim 1, wherein:

the ceramic armor apparatus provides protection against a 5.56 mm bullet and a 7.62 mm bullet either alone or in any combination thereof.

4. The ceramic armor apparatus according to claim 1, wherein:

the ceramic facing element is comprised of Boron Carbide ceramic, Silicon Carbide ceramic or a ceramic matrix composite containing Boron Carbide ceramic and/or Silicon Carbide ceramic particles.

5. The ceramic armor apparatus according to claim 1 wherein:

the ceramic facing element is a continuous monolithic plate that is generally flat, or with single, double, or compound curvature.

6. The ceramic armor apparatus according to claim 1, wherein:

the adhesive layer is comprised of an epoxy adhesive, a polysulfide adhesive, a polyurethane adhesive, or a polyolefin adhesive.

7. The ceramic armor apparatus according to claim 1, wherein:

the ceramic facing element, the adhesive layer, and the aramid fiber composite substrate have a combined thickness that falls in the range between 0.430-inches and 0.530-inches inclusively.

8. The ceramic armor apparatus according to claim 1, wherein:

the ceramic facing element, the adhesive layer, and the aramid fiber composite substrate have a combined weight that falls in the range between 4.00- and 5.70-pounds-per-square-foot inclusively.

9. Ceramic armor apparatus comprising in combination:

a ceramic facing element with thickness of 0.080-inches to 0.310 inches;

an adhesive layer with thickness ranging from 0.002-inches to 0.090-inches; and an aramid fiber composite substrate with thickness of 0.130-inches to 0.350-inches; the aramid fiber composite substrate comprising aramid unidirectional tapes with all tapes arranged in 0, 15, 30, 45, 60, 90-degree orientation or combinations thereof.

10. The ceramic armor apparatus according to claim 9, wherein:

the aramid fiber tapes comprise aramid fibers with fineness ranging from 250- to 3,500-denier.

11. The ceramic armor apparatus according to claim 9, wherein:

the ceramic armor apparatus provides protection against a 5.56 mm bullet and a 7.62 mm bullet either alone or in any combination thereof.

12. The ceramic armor apparatus according to claim 9, wherein:

the ceramic facing element is comprised of Boron Carbide ceramic, Silicon Carbide ceramic or a ceramic matrix composite containing Boron Carbide ceramic and/or Silicon Carbide ceramic particles.

13. The ceramic armor apparatus according to claim 9 wherein:

the ceramic facing element is a continuous monolithic plate that is generally flat, or with single, double, or compound curvature.

14. The ceramic armor apparatus according to claim 9, wherein:

the adhesive layer is comprised of an epoxy adhesive, a polysulfide adhesive, a polyurethane adhesive, or a polyolefin adhesive.

15. The ceramic armor apparatus according to claim 9, wherein:

the ceramic facing element, the adhesive layer, and the aramid fiber composite substrate have a combined thickness that falls in the range between 0.430-inches and 0.530-inches inclusively.

16. The ceramic armor apparatus according to claim 9, wherein:

the ceramic facing element, the adhesive layer, and the aramid fiber composite substrate have a combined weight that falls in the range between 4.00- and 5.70-pounds-per-square-foot inclusively.

17. Ceramic armor apparatus comprising in combination:

a ceramic facing element with thickness of 0.080-inches to 0.310 inches;

an adhesive layer with thickness ranging from 0.002-inches to 0.090-inches; and an aramid fiber composite substrate with thickness of 0.130-inches to 0.350-inches; the aramid fiber composite substrate comprising a three-dimensional aramid fiber fabric structure that incorporates stitching or fiber axes along or about a z-axis of the fabric structure.

18. The ceramic armor apparatus according to claim 17, wherein:

the three-dimensional aramid fiber fabric structure comprises aramid fibers with fineness ranging from 250- to 3,500-denier.

19. The ceramic armor apparatus according to claim 17, wherein:

the ceramic armor apparatus provides protection against a 5.56 mm bullet and a 7.62 mm bullet either alone or in any combination thereof.

20. The ceramic armor apparatus according to claim 17, wherein:

the ceramic facing element is comprised of Boron Carbide ceramic, Silicon Carbide ceramic or a ceramic matrix composite containing Boron Carbide ceramic and/or Silicon Carbide ceramic particles.

21. The ceramic armor apparatus according to claim 17, wherein:

the ceramic facing element is a continuous monolithic plate that is generally flat, or with single, double, or compound curvature.

22. The ceramic armor apparatus according to claim 17, wherein:

the adhesive layer is comprised of an epoxy adhesive, a polysulfide adhesive, a polyurethane adhesive, or a polyolefin adhesive.

23. The ceramic armor apparatus according to claim 17, wherein:

the ceramic facing element, the adhesive layer, and the aramid fiber composite substrate have a combined thickness that falls in the range between 0.430-inches and 0.530-inches inclusively.

24. The ceramic armor apparatus according to claim 17, wherein:

the ceramic facing element, the adhesive layer, and the aramid fiber composite substrate have a combined weight that falls in the range between 4.00- and 5.70-pounds-per-square-foot inclusively.

* * * * *

US006408733C1

(12) EX PARTE REEXAMINATION CERTIFICATE (5856th)

United States Patent

Perciballi

(10) Number: US 6,408,733 C1

(45) Certificate Issued: Aug. 14, 2007

(54) CERAMIC ARMOR APPARATUS FOR MULTIPLE BULLET PROTECTION

(75) Inventor: William J. Perciballi, Phoenix, AZ (US)

(73) Assignee: C Squared Capital Partners L.L.C., Tempe, AZ (US)

Reexamination Request:
No. 90/007,799, Nov. 7, 2005

Reexamination Certificate for:

| | |
|---|---|
| Patent No.: | **6,408,733** |
| Issued: | **Jun. 25, 2002** |
| Appl. No.: | **09/503,494** |
| Filed: | **Feb. 14, 2000** |

(51) Int. Cl.

| | |
|---|---|
| ***F41H 5/04*** | (2006.01) |
| ***F41H 5/08*** | (2006.01) |
| ***F41H 1/02*** | (2006.01) |

(52) U.S. Cl. ..... 89/36.02; 89/36.05; 2/2.5

(58) Field of Classification Search ..... None

See application file for complete search history.

(56) References Cited

U.S. PATENT DOCUMENTS

| | | | |
|---|---|---|---|
| 4,457,985 | A | 7/1984 | Harpell et al. |
| 4,739,690 | A | 4/1988 | Moskowitz |
| 4,813,334 | A | 3/1989 | Bloks et al. |
| 4,836,084 | A | 6/1989 | Vogelesang et al. |
| 5,173,138 | A | 12/1992 | Blauch et al. |
| 5,200,256 | A | 4/1993 | Dunbar |
| 5,229,199 | A | 7/1993 | Miner et al. |
| 5,465,760 | A | 11/1995 | Mohamed et al. |
| 5,536,553 | A | 7/1996 | Coppage, Jr. et al. |
| 5,635,288 | A | 6/1997 | Park |
| 5,677,029 | A | 10/1997 | Prevorsek et al. |
| 5,789,327 | A | 8/1998 | Rousseau |
| 6,000,055 | A | 12/1999 | Citterio |

*Primary Examiner*—Bibhu Mohanty

(57) ABSTRACT

Armor apparatus comprising a non-oxide ceramic element bounded to an aramid fiber composite baking. A special ceramic and a novel aramid fiber substrate are combined in a unique arrangement that permits a single armor system to provide protection against multiple types of ballistic attack. The armor apparatus may be used alone or as a supplementary armor system to provide increased protection from ballistic attack.

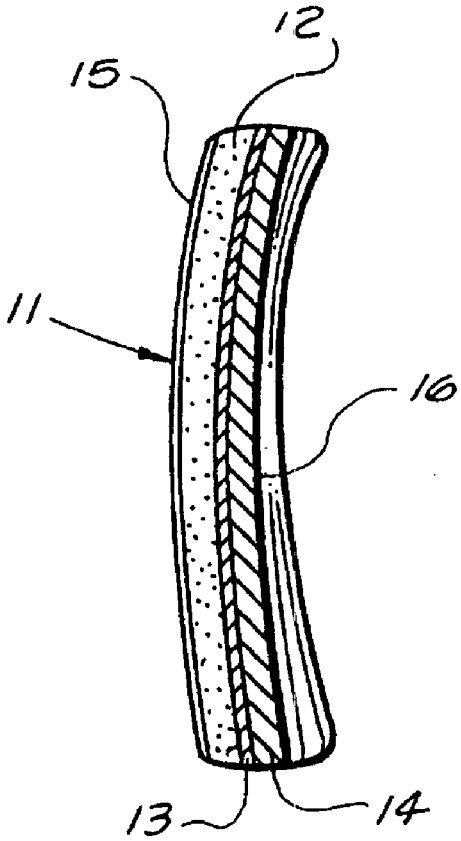

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–24 is confirmed.

New claims 25–27 are added and determined to be patentable.

*25. The ceramic armor apparatus according to claim 1, wherein the adhesive layer is disposed against the ceramic facing element, and the aramid fiber composite substrate comprises a polymer matrix and is disposed against the adhesive layer.*

*26. The ceramic armor apparatus according to claim 9, wherein the adhesive layer is disposed against the ceramic facing element, and the aramid fiber composite substrate comprises a polymer matrix and is disposed against the adhesive layer.*

*27. The ceramic armor apparatus according to claim 17, wherein the adhesive layer is disposed against the ceramic facing element, and the aramid fiber composite substrate comprises a polymer matrix and is disposed against the adhesive layer.*

* * * * *